US008607408B2

(12) United States Patent
Herrett

(10) Patent No.: US 8,607,408 B2
(45) Date of Patent: Dec. 17, 2013

(54) VACUUM CLEANER

(75) Inventor: Michael Herrett, Oakleigh (AU)

(73) Assignee: Uneeda Vac (Australia) Pty Ltd, Mount Waverly, Victoria (AU)

( * ) Notice: Subject to any disclaimer, the term of this patent is extended or adjusted under 35 U.S.C. 154(b) by 369 days.

(21) Appl. No.: 12/994,488

(22) PCT Filed: Oct. 8, 2009

(86) PCT No.: PCT/AU2009/001330

§ 371 (c)(1),
(2), (4) Date: Nov. 24, 2010

(87) PCT Pub. No.: WO2010/040178

PCT Pub. Date: Apr. 15, 2010

(65) Prior Publication Data

US 2011/0078873 A1 Apr. 7, 2011

(30) Foreign Application Priority Data

Oct. 8, 2008 (AU) ..... 2008905221

(51) Int. Cl.
*A47L 9/20* (2006.01)

(52) U.S. Cl.
USPC ..... 15/352; 15/353; 55/430; 55/432; 55/493; 55/DIG. 3

(58) Field of Classification Search
USPC ..... 15/352, 353; 55/430, 432, 493, DIG. 3
IPC ..... A47L 9/20
See application file for complete search history.

(56) References Cited

U.S. PATENT DOCUMENTS

| | | | | |
|---|---|---|---|---|
| 3,780,502 | A * | 12/1973 | Dupre et al. | 55/337 |
| 4,885,817 | A * | 12/1989 | Tanase | 15/340.1 |
| 6,406,505 | B1 | 6/2002 | Oh et al. | |
| 7,014,675 | B2 | 3/2006 | Nakai et al. | |

FOREIGN PATENT DOCUMENTS

| | | |
|---|---|---|
| DE | 33 02 297 | 7/1984 |
| JP | 54-050154 | 4/1979 |
| JP | 2003-019094 | 1/2003 |
| JP | 2007-151856 | 6/2007 |
| JP | 2009-072730 | 9/2009 |
| KR | 1020050054551 | 6/2005 |
| WO | WO 2006/021489 | 3/2006 |

OTHER PUBLICATIONS

International Search Report dated Dec. 8, 2009 for Application No. PCT/AU2009/001330.
Written Opinion dated Dec. 8, 2009 for Application No. PCT/AU2009/001330.

* cited by examiner

*Primary Examiner* — David Redding
(74) *Attorney, Agent, or Firm* — Garcia-Zamor IP Law; Ruy M. Garcia-Zamor

(57) ABSTRACT

In a vacuum cleaner (1) particulate matter (32) accumulates on a counter-weighted flap (4). When the weight of the particulate matter (32) exceeds the effect of the counterweight (15) and the effect of any air-pressure differential across the flap (4), the flap opens and voids particulate matter (32) from within the vacuum cleaner (1).

6 Claims, 6 Drawing Sheets

VACUUM CLEANER

FIELD OF THE INVENTION

The present invention relates to vacuum cleaners and the like and in particular to such cleaners which are, to some degrees self-emptying.

BACKGROUND OF THE INVENTION

Typical vacuum cleaners have an electrically-powered motor which drives a fan. Rotation of the fan induces an airflow which entrains dust and other trash. Typically a filter or a cyclonic separator is used to separate the entrained dust and other trash from the airflow. (Throughout this specification, including the claims, such material is referred to as "particulate matter".) This separated particulate matter is accumulated in a dust-collecting chamber, dust bag, filter bag or the like and must. Sooner or later, be removed so that the cleaner can continue to operate. It is desirable that human intervention in this removal of particulate matter from the cleaner be reduced or eliminated.

SUMMARY A THE INVENTION

The present invention accordingly provides a vacuum cleaner or the like comprising a closure, element which:

- is biased towards a position in which the closure element acts to retain accumulated particulate matter within the cleaner; and
- which is influenced by the weight of accumulated particulate matter to move to a position in which the closure element does not act to retain accumulated particulate matter within the cleaner.

It is preferred that the closure element is a flap on which at least a portion of the particulate matter accumulates.

It is preferred that the vacuum cleaner or the like further comprises a housing and in which:

- the flap further comprises a counterweight; and
- the flap is hingedly mounted to the housing to allow movement of the flap between:
  - the position in which the closure element acts to retain accumulated particulate matter within the cleaner and
  - the position in which the closure element does not act to retain accumulated particulate matter within the cleaner It is preferred that the housing, comprises an open-ended frustro-conical portion and the flap acts to retain accumulated particulate matter within the cleaner by substantially occluding the open end of the frustro conical portion of the housing.

It is preferred that centripetal forces on air-entrained particulate matter as it moves around the inner surface of the open-ended frustro-conical portion influence that particulate matter to accumulate on the flap.

It is preferred that the vacuum cleaner or the like further comprises a filter which is substantially conical and which carries ballast in the vicinity of the tip of the cone which acts to counteract the effect of pressure differential forces across the filter.

It will accordingly be seen that embodiments of the present invention reduce the amount of human intervention involved in emptying the cleaner.

BRIEF DESCRIPTION OF THE DRAWINGS

So that the present invention may be more readily understood, preferred embodiments of it are described in conjunction with the accompanying drawings in which.

DESCRIPTION OF PREFERRED EMBODIMENTS OF THE INVENTION

Components

Figure 1:
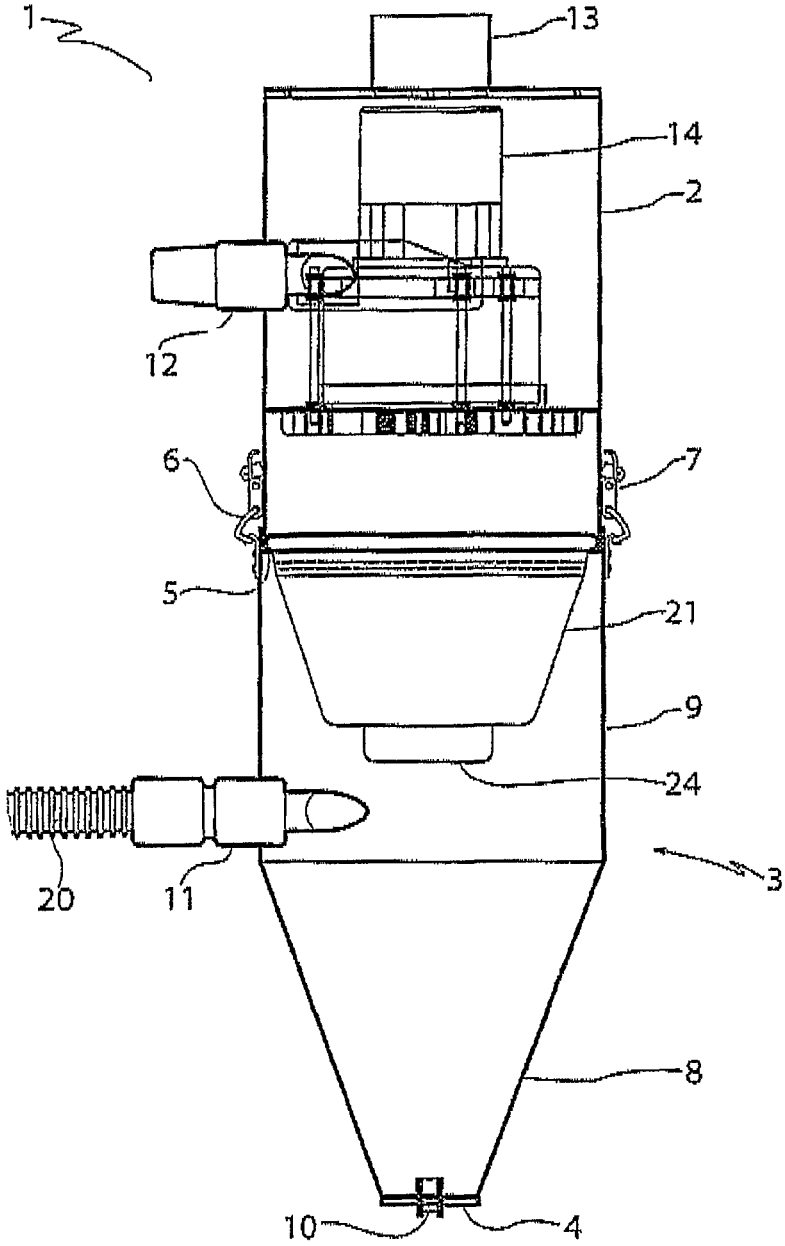
FIG. 1 is a view, partly in front elevation and partly in section, of a vacuum cleaner according to one embodiment of the present invention.

FIG. 1 illustrates a vacuum cleaner 1 according to preferred embodiments of the present invention, The vacuum cleaner 1 comprises an upper easing portion 2 and a separable lower casing portion 3. The separable lower casing portion 3 is readily detachably mounted on the upper casing portion 2, by use of over-the-centre lever connections 6 and 7. The preferred material for the casing is mild steel, The upper casing portion 2 is substantially cylindrical in configuration while the lower casing portion 3 comprises a cylindrical portion 9 which is formed integrally with a frustro-conical portion 8.

A closure flap 4 is hingedly mounted on the frustro-conical portion 8 by hinge 10. The flap 4 is formed integral with a counter-weight 15. The action of the counter-weight 15 biases the flap 4 into a position in which it closes off the open lower end of the frustro-conical portion 8, An inwardly-projecting circumferential shoulder 5 is formed at the upper end of the lower casing portion 8.

An airflow inlet 11 is substantially tangentially mounted on the cylindrical portion 9 of the lower easing 3, in the vicinity of the transition to the upper end of the frustro-conical portion 8, An airflow, outlet 12 is substantially tangentially mounted on the motor 14.

An air-cooling inlet 13 protrudes from the upper end of the upper casing portion 2, and is mounted substantially coaxially with that upper casing portion 2. The air-cooling inlet 13 functions as an inlet of cooling air, such as air from outside or from an air-conditioning system.

Figure 2:
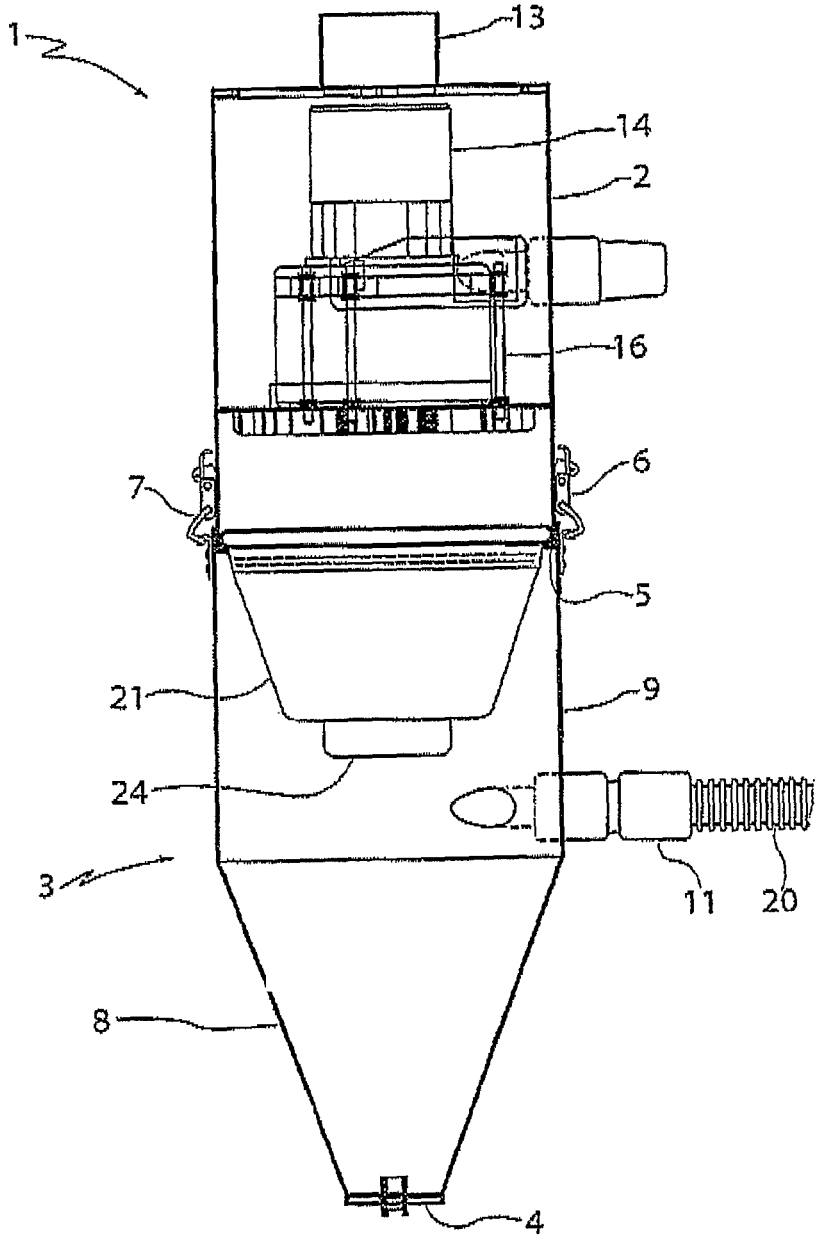
FIG. 2 is a view, partly in rear elevation and partly in cross-section, of the embodiment of FIG. 1.
Figure 3:
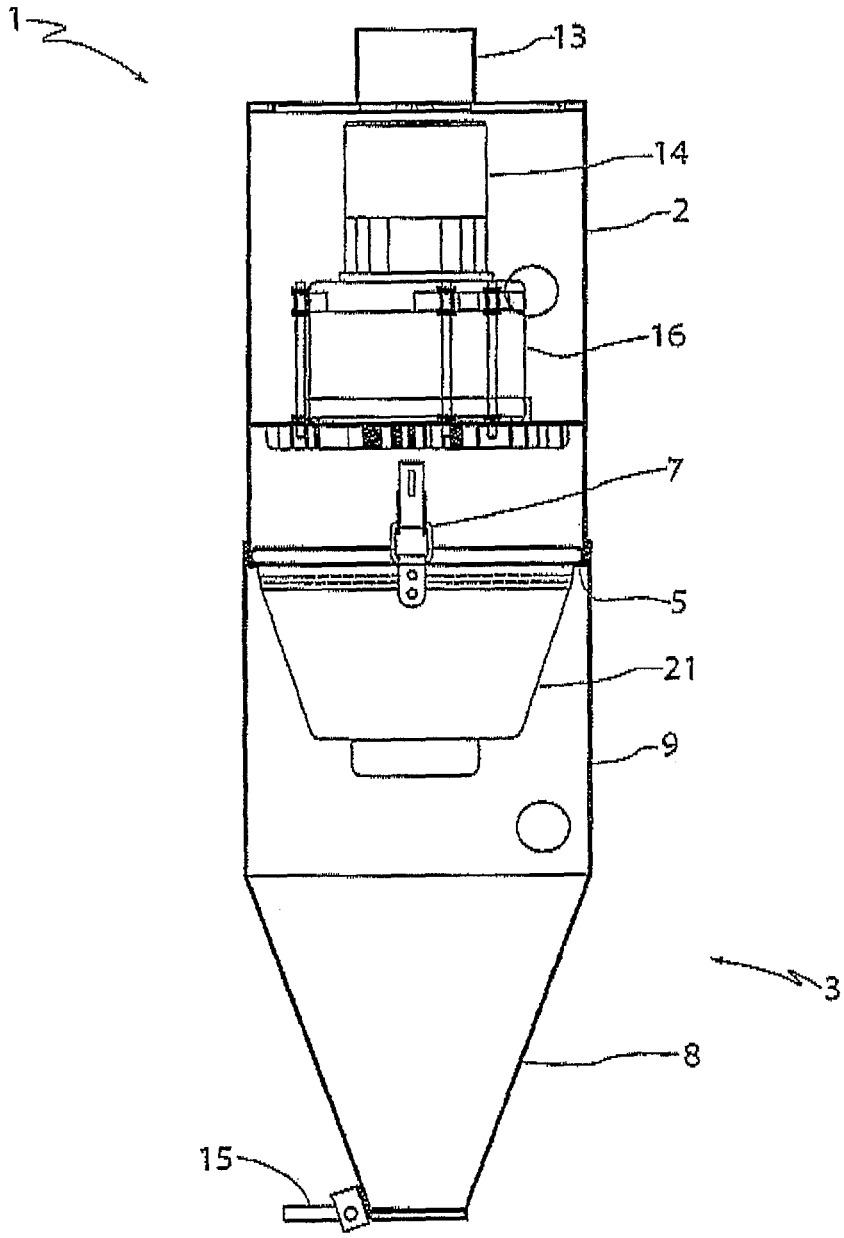
FIG. 3 is a view, partly in elevation when viewed from the left hand side of FIG. 1 and partly in cross section, or the embodiment of FIG. 1.
Figure 4:
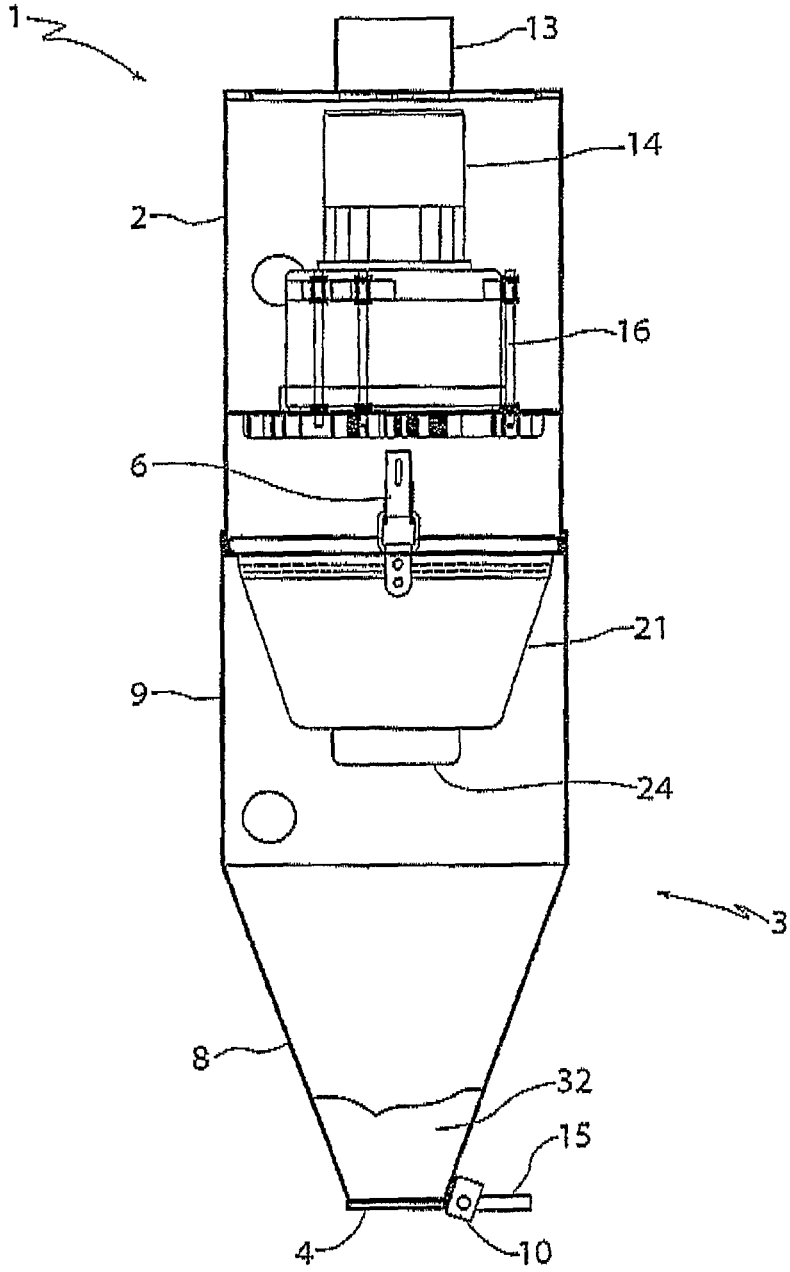
FIG. 4 is a view, partly in elevation when viewed from the right hand side of FIG. 1 and partly in cross-section, illustrating operation, of the embodiment of FIG. 1.

As is illustrated in FIG. 2, an electric motor 14 is mounted substantially coaxially within the upper casing portion 2 and is directly coupled to a fan 16. Preferred forms of motor and fan combination are two or three stage 24 volt or 240 volt units, Especially preferred forms include 24 volt, Lamb Electric vacuum motor, model numbers 11651513, 116515-29 or 116515-32.

Figure 6:
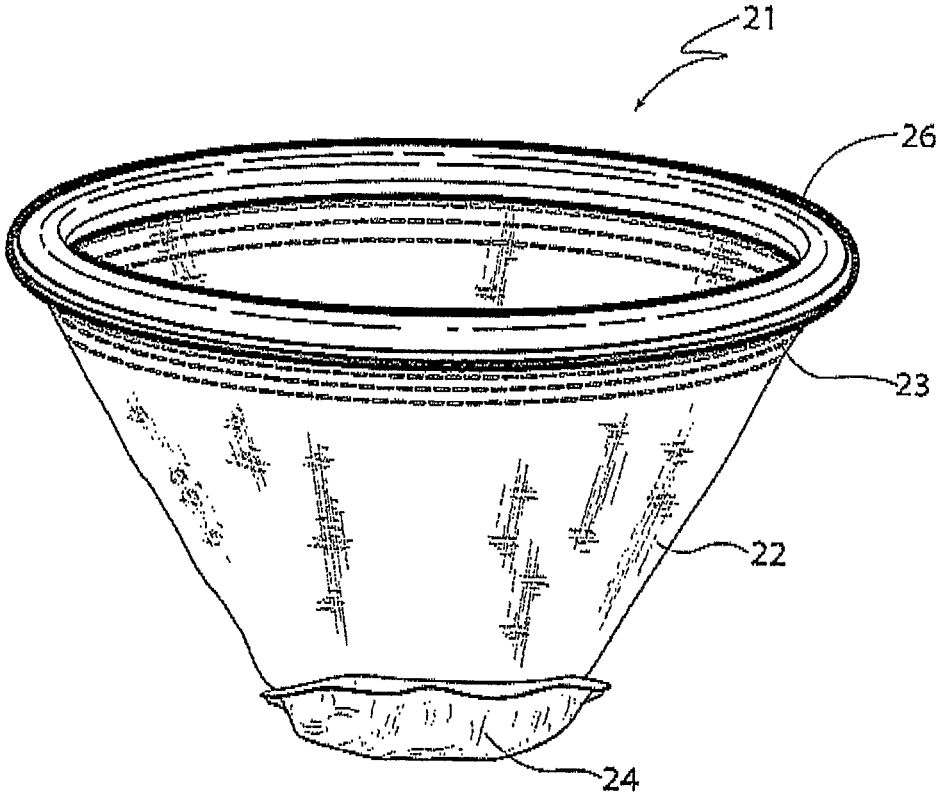
FIG. 6 illustrates a component of the embodiment of FIG. 1.

As is illustrated in FIG. 6, the filter 21 comprises filter fabric 22 which is sewn into a substantially conical shape. The circumference of the filter fabric 22 is in turn sewn into a rubber skirt 23 which is formed integrally with a seal 26. Preferred materials for the filter fabric are denim, Gore-Tex, calico, rubber-backed cotton material and felt. The seal 26 functions as a seal between upper casing portion 2 and lower easing portion 3, The filter 21 is simply retained in place by the retention of the seal 26 between upper casing portion 2 and lower casing portion 3.

As is illustrated in FIG. 6, a Closed pocket 24 is sewn onto the filter fabric 22, The pocket 24 is formed to lie on the outside of the cone that is formed from the filter fabric 22 and is in a position which is substantially at the base of that cone. The pocket 24 is charged with ballast. Preferred forms of ballast include lead shot and rice.

Assembly

The vacuum cleaner 1 is assembled for use with the filter 21 in place. The ballast which is within the pocket 24 biases the filter 21 downwards. The filter seal 26 reposes in the circumferential shoulder 5 at the upper end of lower casing portion 3 and is retained in that position by the lower circumferential edge of the upper casing portion 2.

Figure 5:
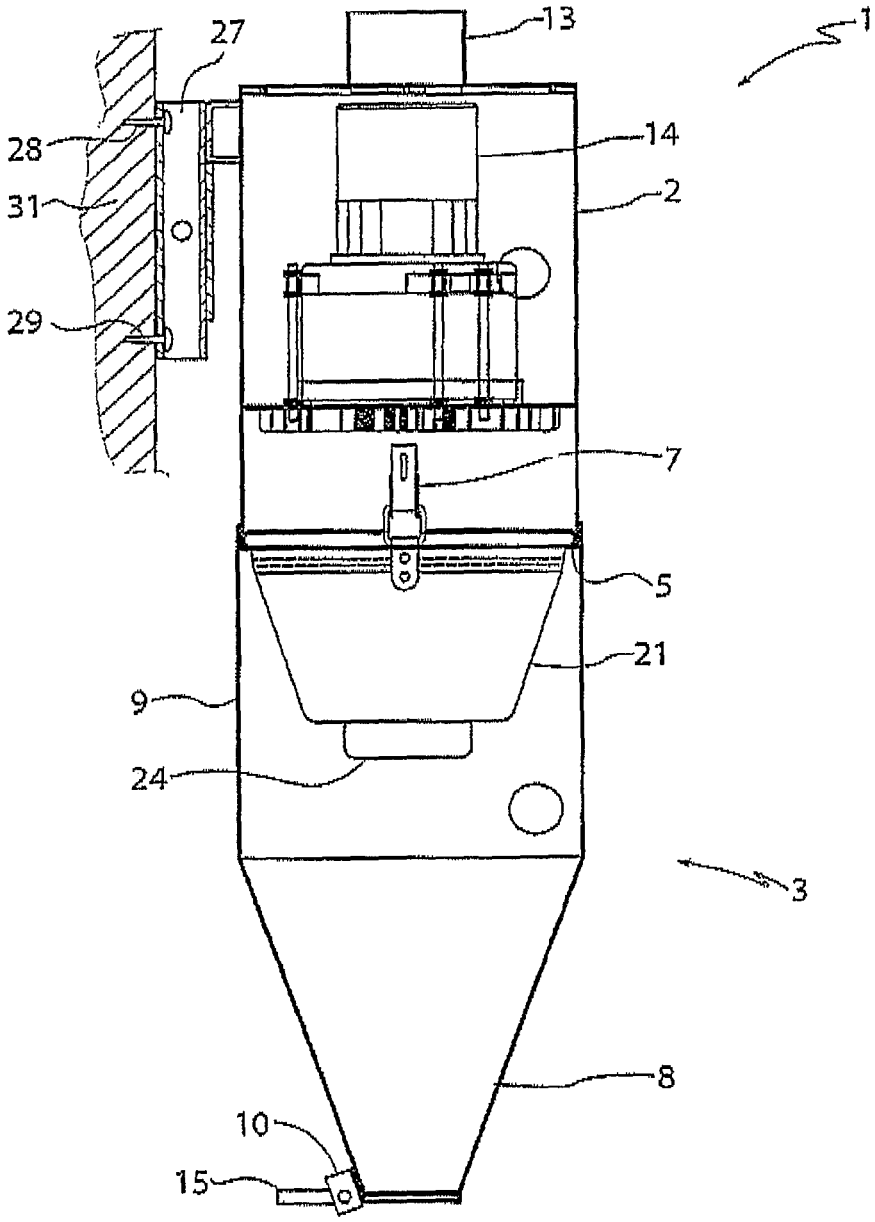
FIG. 5 is a view, partly in elevation when viewed from the left hand side of FIG. 1 and partly in cross-section, illustrating the embodiment of FIG. 1 when mounted to a mounting.

As is illustrated in FIG. 5, when in use the vacuum cleaner 1 is mounted so that its central axis is substantially vertical. In the embodiment of FIG. 5, this is achieved by use of a mounting bracket 27 which is attached to the upper casing portion 2. The mounting bracket 27 is in turn attached to a wall 31 or the like by use of upper and lower fasteners 28 and 28 which pass through the mounting bracket 37 and into the wall 31.

Operation

In use, the vacuum cleaner 2 is mounted with its axis substantially vertical on a wall or the like. An air inlet hose 20 is attached to the airflow inlet 11 in the conventional manner. Energization of the electric motor 14 causes induction of air into the cleaner 2 through the airflow inlet 11. The tangential orientation of the airflow inlet 11 promotes movement of entrained particulate matter around the inner circumference of the frustro-conical portion 8. Centripetal nation causes heavier entrained particles stay close to the inside wall of the frustro-cortical portion 8 and also gravitate to the lower end of that portion where they accumulate on the closure flap 4. The weight of particulate matter 32 resting on the closure flap 4 tends to be counteracted by two forces:

- the closing moment on the flap 4 which is generated by the counter weight 15; and the moment of force generated by the air pressure differential on opposite flat faces of the flap 4.

The closure flap 4 opens to void particulate matter 32 from the cleaner 2 in either of two circumstances:

- when the power is turned off, and the weight of particulate matter 32 generates a moment of force which is greater than the moment which is generated by the counterweight 15; or
- when the power is turned on, and the weight of particulate matter 32 generates a moment of force which is greater than the sum of the moments generated by the counterweight 15 and the pressure differential acting on opposite flat faces of the flap 4.

According to the embodiments of FIGS. 1 to 6, the motor and fan generate a vacuum pressure of 15 kilopascals and the effective diameter of the closure flap 4 which is exposed to the vacuum is 56 mm, The closing force on the flap 4 generated by the pressure differential across it by a vacuum pressure of 15 kilopascals is the equivalent of 3.7 kilograms weight. Thus the weight of particulate matter 32 accumulated on the flap 4 in order to cause self-emptying of the cleaner when the cleaner is turned on would need to exceed 3.7 kilograms, plus the counter-balancing effect of the counterweight 15.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

"Comprises/comprising" when used in this specification is taken to specify the presence of stated features, integers, steps or components but does not preclude the presence or addition of one or more other features, integers, steps, components or groups thereof.

In the claims, each dependent claim is to be read as being within the scope of its parent claim or claims, in the sense that a dependent claim is not to be interpreted as infringed unless its parent claims are also infringed.

The claims defining the invention are as follows:

1. A vacuum cleaner comprising a closure element which:

is biased towards a position in which the closure element acts to retain accumulated particulate matter within the cleaner; and which is influenced by the weight of accumulated particulate matter to move to a position in which the closure element does not act to retain accumulated particulate matter within the cleaner; and in which the closure element is a flap on which at least a portion of the particulate matter accumulates; and further comprising a housing and in which:

the flap further comprises a counterweight; and the flap is hingedly mounted to the housing to allow movement of the flap between:

the position in which the closure element acts to retain accumulated particulate matter within the cleaner and the position in which the closure element does not act to retain accumulated particulate matter within the cleaner; and in which the housing comprises an open-ended frusto-conical portion and the flap acts to retain accumulated particulate matter within the cleaner by substantially occluding the open end of the frusto-conical portion of the housing; and in which centripetal forces on air-entrained particulate matter as it moves around the inner surface of the open-ended frusto-conical portion influence that particulate matter to accumulate on the flap.

2. A vacuum cleaner comprising a closure element which:

is biased towards a position in which the closure element acts to retain accumulated particulate matter within the cleaner; and which is influenced by the weight of accumulated particulate matter to move to a position in which the closure element does not act to retain accumulated particulate matter within the cleaner; and further comprising a filter which is substantially conical and which carries ballast in the vicinity of the tip of the cone which acts to counteract the effect of pressure differential forces across the filter.

3. A vacuum cleaner as claimed in claim 2, in which the closure element is a flap on which at least a portion of the particulate matter accumulates.

4. A vacuum cleaner as claimed in claim 3, further comprising a housing and in which:

the flap further comprises a counterweight; and the flap is hingedly mounted to the housing to allow movement of the flap between:

the position in which the closure element acts to retain accumulated particulate matter within the cleaner and the position in which the closure element does not act to retain accumulated particulate matter within the cleaner.

5. A vacuum cleaner as claimed in claim 4, in which the housing comprises an open-ended frusto-conical portion and the flap acts to retain accumulated particulate matter within the cleaner by substantially occluding the open end of the frusto-conical portion of the housing.

6. A vacuum cleaner as claimed in claim 5, in which centripetal forces on air-entrained particulate matter as it moves around the inner surface of the open-ended frusto-conical portion influence that particulate matter to accumulate on the flap.

* * * * *